US007526999B1

(12) United States Patent
Timan

(10) Patent No.: US 7,526,999 B1
(45) Date of Patent: May 5, 2009

(54) LESS-LETHAL FORCE DEVICE

(76) Inventor: Bruce A. Timan, 8423 Foothill Blvd., Pine Valley, CA (US) 91962

( * ) Notice: Subject to any disclaimer, the term of this patent is extended or adjusted under 35 U.S.C. 154(b) by 318 days.

(21) Appl. No.: 11/353,875

(22) Filed: Feb. 13, 2006

(51) Int. Cl.
*F41C 27/06* (2006.01)

(52) U.S. Cl. ..... 102/502; 102/503; 42/105

(58) Field of Classification Search ..... 42/105, 42/106, 1.12; 102/502, 504, 485, 483, 484; 89/1.34
See application file for complete search history.

(56) References Cited

U.S. PATENT DOCUMENTS

| | | | | | |
|---|---|---|---|---|---|
| 1,900,790 | A | * | 3/1933 | Brandt | 102/485 |
| 3,491,693 | A | * | 1/1970 | Streckfuss et al. | 102/485 |
| 3,620,162 | A | * | 11/1971 | King | 102/485 |
| 3,664,263 | A | * | 5/1972 | Driscoll | 102/485 |
| 3,726,036 | A | * | 4/1973 | Jennings et al. | 42/105 |
| 3,733,727 | A | | 5/1973 | Jones et al. | |
| 3,791,303 | A | | 2/1974 | Sweeney et al. | |
| 3,898,932 | A | | 8/1975 | Flatau et al. | |
| 3,951,070 | A | | 4/1976 | Flatau et al. | |
| 3,982,489 | A | | 9/1976 | Flatau et al. | |
| 4,013,011 | A | * | 3/1977 | Gabriels | 102/485 |
| 4,030,421 | A | | 6/1977 | Litman | |
| 4,190,476 | A | | 2/1980 | Flatau et al. | |
| 4,505,179 | A | * | 3/1985 | Nelson et al. | 89/16 |
| 4,506,604 | A | | 3/1985 | Hughes | |
| 4,567,831 | A | * | 2/1986 | Gordon et al. | 102/485 |
| 4,747,349 | A | * | 5/1988 | Schilling et al. | 102/485 |
| 4,776,255 | A | * | 10/1988 | Smith | 89/1.13 |
| 4,793,259 | A | * | 12/1988 | Ambrosi et al. | 102/485 |
| 4,799,906 | A | * | 1/1989 | Perkins, Jr. | 441/85 |
| 4,823,702 | A | | 4/1989 | Woolsey | |
| 4,908,971 | A | | 3/1990 | Chaney | |
| 5,099,747 | A | * | 3/1992 | Smith | 89/1.13 |
| 5,257,936 | A | * | 11/1993 | Ambrosi et al. | 434/11 |
| 5,349,906 | A | * | 9/1994 | Devaux et al. | 102/485 |
| 5,377,438 | A | | 1/1995 | Sheinfeld et al. | |
| 5,448,937 | A | * | 9/1995 | Buc et al. | 89/1.34 |
| 5,574,245 | A | * | 11/1996 | Buc et al. | 102/485 |
| 5,654,524 | A | | 8/1997 | Saxby | |
| 6,378,439 | B1 | | 4/2002 | Saxby | |
| 6,408,765 | B1 | * | 6/2002 | Tauber et al. | 102/499 |
| 6,523,478 | B1 | * | 2/2003 | Gonzalez et al. | 102/485 |
| 6,619,179 | B2 | | 9/2003 | Mika | |
| 6,688,032 | B1 | * | 2/2004 | Gonzalez et al. | 42/105 |
| 6,981,449 | B2 | * | 1/2006 | Sadeck | 102/485 |
| 7,296,375 | B2 | * | 11/2007 | Brunn | 42/105 |
| 2003/0019352 | A1 | | 1/2003 | Mika | |
| 2004/0069177 | A1 | | 4/2004 | Klein | |

FOREIGN PATENT DOCUMENTS

| | | | | |
|---|---|---|---|---|
| FR | 604510 | A | * | 5/1926 |
| WO | WO 0111305 | A2 | * | 2/2001 |

* cited by examiner

*Primary Examiner*—Troy Chambers
*Assistant Examiner*—Benjamin P Lee
(74) *Attorney, Agent, or Firm*—Lewis and Roca LLP

(57) ABSTRACT

The present disclosure relates to a less-lethal projectile device generally comprising a projectile, such as a rubber-encapsulated metal block, that is mated to a docking base by way of a mounting tube. The projectile may be milled with a cavity located in its rearward section for enabling the projectile to fit onto the mounting tube portion of the docking base through compression. The projectile captures a fired bullet and is propelled along the original path of the bullet. The disclosed system results in a normally lethal weapon being converted into a less-lethal blunt impact system.

18 Claims, 5 Drawing Sheets

LESS-LETHAL FORCE DEVICE

BACKGROUND

1. Field of the Disclosure

The disclosure relates generally to a less-lethal force device such as those used by law enforcement.

2. The Prior Art

Less-lethal weapon systems are well known in the art. Examples include rubber bullets, electronic restraint devices, and the like. However, prior art devices possess several flaws. Many existing less-lethal systems do not allow law enforcement officers immediate access to the less-lethal weapon. Many are too cumbersome to be carried by uniform or plain-clothes officers comfortably, concealably, and safely. Such flaws thus prevent law enforcement officers from having quick access to such devices in high-pressure emergency situations.

Additionally, many existing less-lethal weapons require additional equipment (such as a special dedicated weapon) in order to be deployed. Examples of these include "bean bag" projectiles, which generally require a special shotgun to fire the munitions, and electrical shocking devices, which require their own specially integrated firearm. Equipment of this type is not able to accompany the officer who patrols on foot, and therefore is of limited utility since they may not be readily accessible when critical situations suddenly arise away from the cruiser. Hence, these systems may be perceived as being cumbersome, and are often relegated to storage in the locked rack within a police cruiser or the trunk of the vehicle.

Devices of the prior art may also require significant administrative man-hours to develop the familiarity and training necessary for personnel to properly, reliably, and safely utilize the equipment. Thus, such systems are often cost prohibitive for small law enforcement agencies, and may allow for only spotty deployment in larger agencies.

Less-lethal devices are designed to be used in critical situations, such as crowd control operations outdoors, or when an aggressor must be restrained in residential or public settings, including public transportation settings. Few devices of the prior art can be deployed within such a wide range of circumstances, allowing their use outdoors, indoors, and within confined, populated, and fragile spaces, such as the interior of airliners or businesses. Many devices are subject to a loss of potency, deterioration, or reliability due to age, temperature, and humidity. Finally, many prior art systems subject officers to a period of vulnerability during the transition from lethal, to less-lethal, and back to lethal weaponry.

BRIEF DESCRIPTION OF THE DRAWING FIGURES

DETAILED DESCRIPTION

Figure 1:
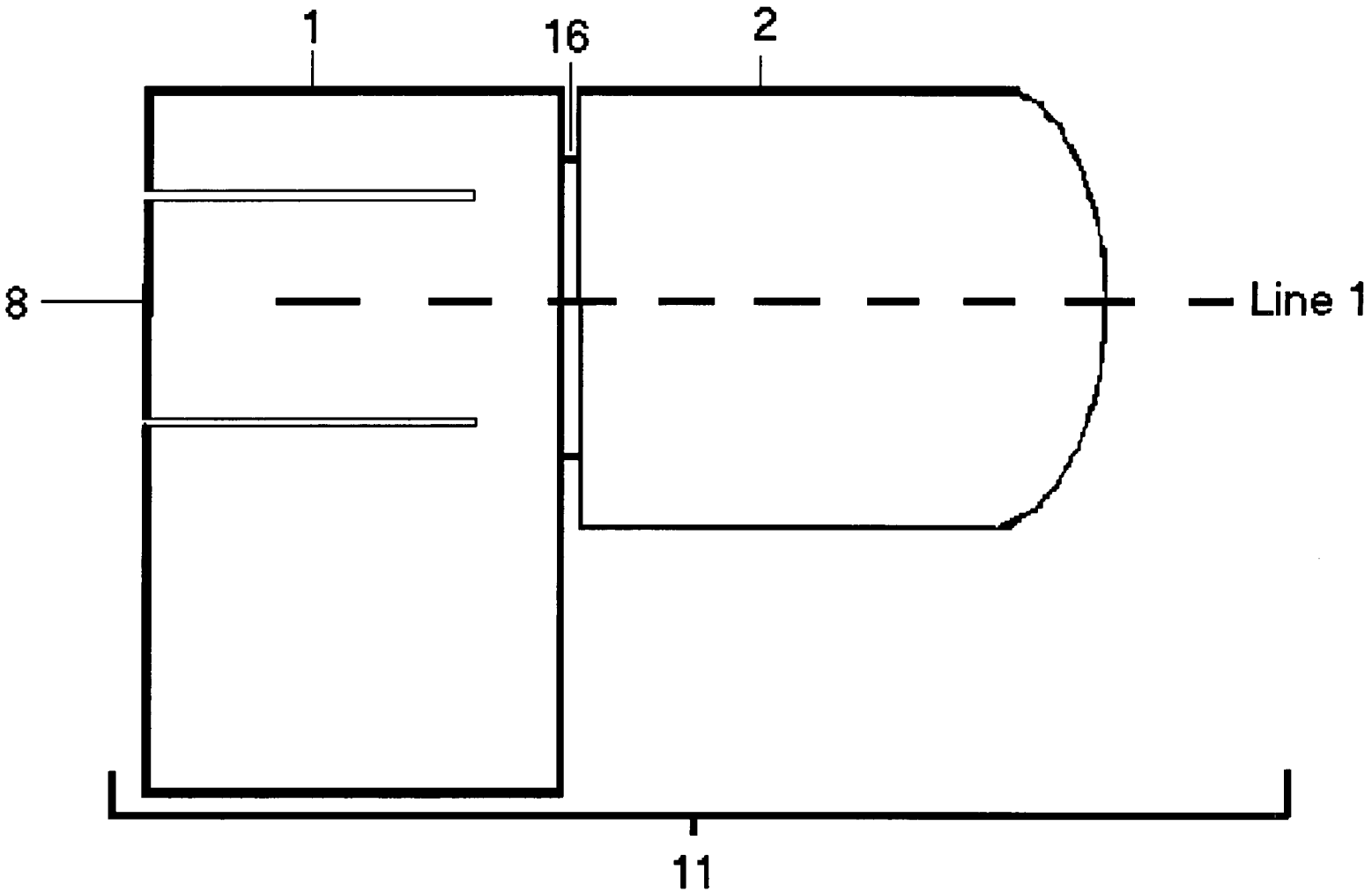
FIG. 1 is a side view of less-lethal projectile device configured in accordance with the teachings of this disclosure.

Persons of ordinary skill in the art will realize that the following description is illustrative only and not in any way limiting. Other modifications and improvements will readily suggest themselves to such skilled persons having the benefit of this disclosure. In the following description, like reference numerals refer to like elements throughout.

The present disclosure relates to a less-lethal projectile device that overcomes the problems of the prior art. The device generally comprises a projectile, such as a rubber-encapsulated metal block, that is mated to a docking base by way of a mounting tube. The projectile may be milled with a cavity located in its rearward section for enabling the projectile to fit onto the mounting tube portion of the docking base through compression. This cavity also serves as a bullet trap as will be disclosed below.

A benefit of the disclosed device is that the docking base may be attached directly onto a firearm with the tube and projectile aligned with the barrel of the weapon. Variants of the disclosed designs may be specifically formed to be removably affixed to a specific model of firearm. The attached device may be kicked off during the recoil operation of the weapon in firing the projectile, returning the firearm a normal state of lethal operation.

In operation, the fired bullet travels forward through the gun barrel towards the disclosed device. The bullet then leaves the barrel of the firearm, where a portion of the excess gas and energy generated during firing is harmlessly bled off, and immediately enters the mounting tube of the attached device. The bullet exits the mounting tube and is caught in the bullet trap portion of the projectile.

The remaining kinetic energy of the bullet is transferred to the projectile, which is propelled forward, separating from the mounting tube and moving forward along the same line of travel as the bullet had taken. The projectile is now traveling at a lesser rate of speed and with less kinetic energy than the bullet had when it exited the barrel of the firearm. The speed and kinetic energy relationship is calculated into the design of the adjustable venting gasket and the vents on the mounting tube so as to bleed off a measured portion of the gas, taking into account the greater mass of the projectile and the projectile speed desired.

The docking base of the disclosed device is designed to clear from the firearm immediately following the departure of the bullet from the weapon. This action allows the weapon to instantaneously return to a lethal state in the event that the projectile misses its target or is ineffective in nullifying the threat, thereby making possible the application of lethality as necessary in an escalation of force situation.

Embodiments of the disclosed device may also be employed to breach semi-substantial barriers (i.e. windows, doors, light barricades) ahead of the delivery of chemical agents such as CS, CN, or Oleoresin Capsicum (pepper spray) as well as deliver chemical agents within the projectile, or for the conveyance of leader filament attached to a docking line or rescue rope. Further embodiments may also be configured with field-adjustable vents to allow the officer to adjust the projectile speed at the point of use.

Variants of disclosed designs may include production of different models to accommodate a wide variety of specific firearms for use, with the disclosed system. Design considerations may include the caliber and weight of the ammunition, and the overall energy characteristics of the bullet fired from that particular weapon, as well as the desired projectile speed.

As a result of the disclosed system, the combination of the larger mass, increased cross sectional area, and the cushioned nature of the projectile, coupled with the reduced speed/kinetic energy of the projectile results in a normally lethal weapon being converted into a less-lethal blunt impact system.

Embodiments of a less-lethal device will now be disclosed.

Referring first to FIG. 1, a side view of a less-lethal device 11 configured in accordance with the teachings of this disclosure is shown. The device 11 includes a docking base 1, a mounting tube 16, and a projectile 2. FIG. 1 also shows a compression/expansion tab 8 formed into docking base 1 for providing a compression force to releasably attach the base to the barrel of a firearm, as will be more fully disclosed below. The components of the device 11 are preferably aligned along an axis Line 1, defined by the trajectory of a bullet passing the device 11.

The vents 5 and the adjustable venting gasket 9 are preferably configured to relieve pressure in such a manner as to prevent the projectile from prematurely being launched. In one embodiment, the vents 5 may have a length of between about 0.100 inches and 0.500 inches and a width of between about 0.025 inches and about 0.250 inches. As will be appreciated by those of ordinary skill in the art, the interior of the barrel is at normal atmospheric pressure prior to the firing of the bullet. After firing, the bullet travels forward and compresses this atmosphere, possibly resulting in the projectile being forced off the tube prior to the bullet being trapped in the bullet trap. Furthermore, as the seal between the bullet and the barrel is not absolute, some of the expanding gas leaks around the circumference of the bullet as it travels along the barrel. This gas, along with the pressure being created in front of the bullet must be bled off or the projectile will become airborne before the bullet is captured and the kinetic force is transferred. The vents 5 and gasket 9 are preferably formed to allow enough pressurized gas to escape to facilitate the proper capture of the bullet by the projectile, thereby ensuring a consistent launch of the projectile. This escaping gas may be used to slightly pre-launch the projectile in order to preserve the kinetic energy of the bullet, and to facilitate maximum energy transfer of the bullet to the projectile. Consequently, as more gas energy is transferred to the projectile, the speed of the projectile will increase and the projectile will attain more knock-down power.

Figure 2A:
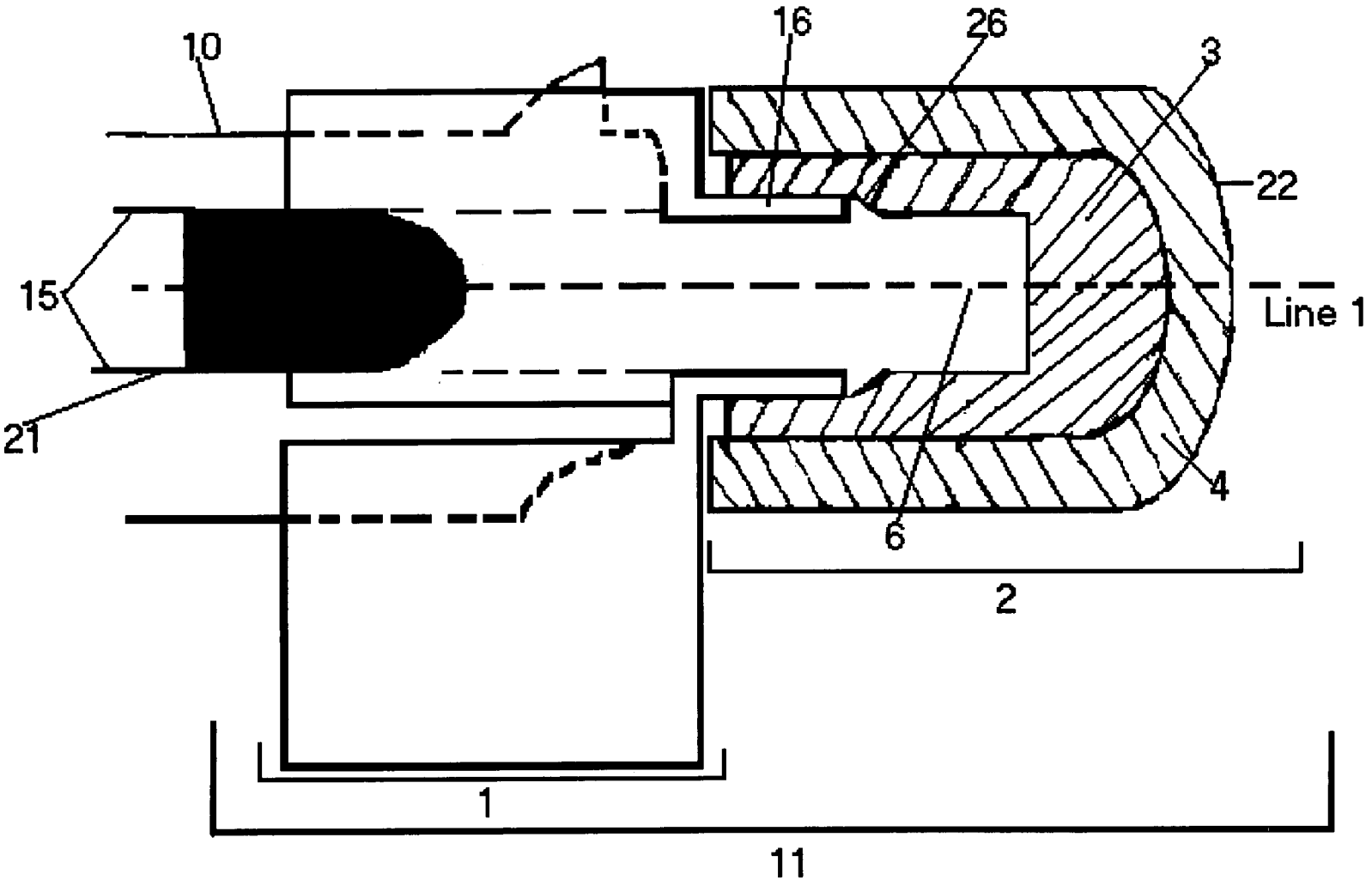
FIGS. 2A and 2B are cross-sectional views of a less-lethal projectile device configured in accordance with the teachings of this disclosure.
Figure 2B:
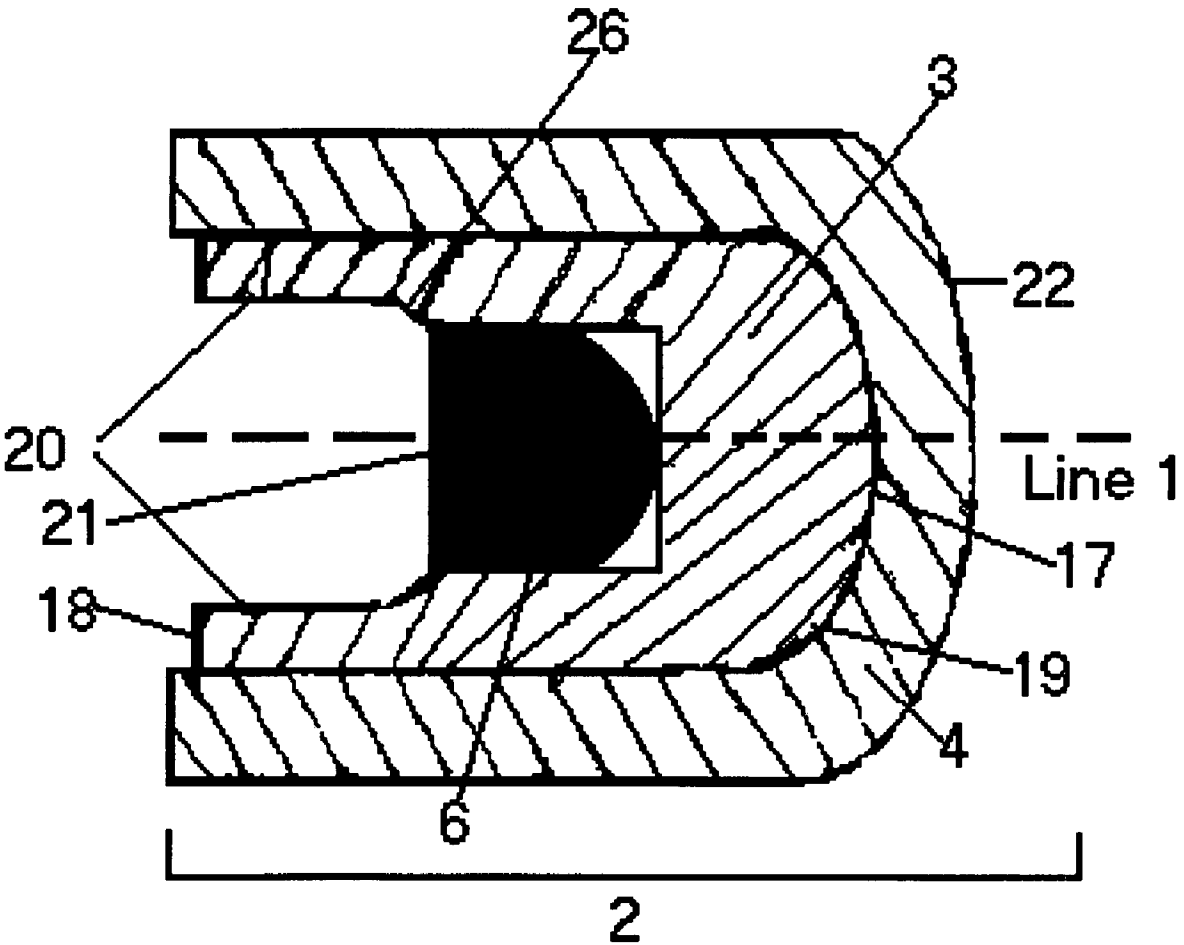

FIGS. 2A and 2B are cross-sectional diagrams of less-lethal device 11 configured in accordance with the teachings of this disclosure. FIGS. 2A and 2B illustrate the device 11 in operation and illustrate to capture and launching of a bullet 21 along Line 1.

A more detailed cross-sectional diagram of a projectile is shown in FIGS. 2A and 2B. In a preferred embodiment, the projectile 2 comprises a rubber outer cushioning sleeve 4 formed over a cylindrical projectile block 3. The projectile block 3 may be formed from aluminum or other like material and is preferably cylindrical in shape. The front surface 19 of the projectile block 3 and the front surface 22 of the rubber cushioning sleeve 4 are preferably formed in a rounded, aerodynamic, manner, shaped to reduce air resistance and increase stability during flight.

The rubber cushioning sleeve 4 is preferably formed from a material of sufficient density such that air resistance in flight will not alter its shape, yet the force will be minimized upon impact with a target so as to impart only blunt trauma to the target. The sleeve 4 may be glued or extruded onto the projectile block 3, and will extend the rear end 18 of the projectile block 3 to allow for impact cushioning should the projectile rotate during flight. It is contemplated that the sleeve 4 may be formed of synthetic or natural rubber, urethane, of either the open or closed cell variety. A wide variety of rubberized compounds may be utilized, with the type and thickness being chosen in relation to the desired impact and type of weapon utilized.

It is contemplated that a one-piece projectile may be employed in the present disclosure. For example, a one-piece projectile may be created for a specific purpose, such as knocking open a door or window, destroying a lock on a locker without having a bullet flying around inside the locker, or for the delivery of chemical agents into a closed space.

Figure 3:
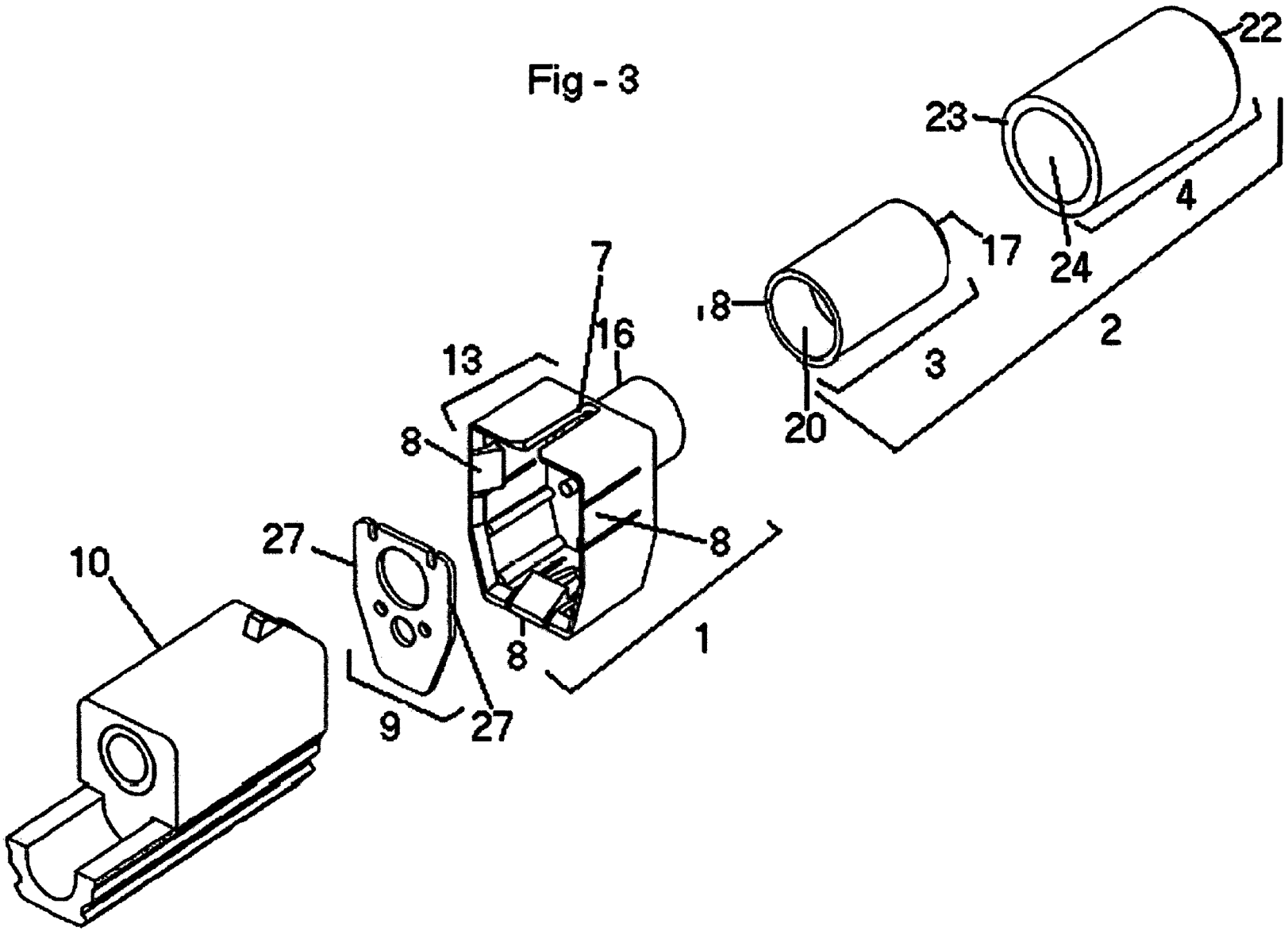
FIG. 3 is an exploded perspective view of a less-lethal projectile device configured in accordance with the teachings of this disclosure.

Referring briefly to FIG. 3, the rubber-cushioning sleeve 4 is shown as including a forward end 22 and a rearward end 23, with the cylindrical surfaces of the sleeve defining an interior cavity 24. FIG. 3 also shows that the projectile block 28 includes a rounded forward nose portion 19 and a rear portion 18, and further includes an interior cavity 25 formed therein.

FIG. 3 further shows that the sleeve 4 and the projectile block 3 are preferably assembled in a concentric fashion about the axis defined by Line 1 in FIG. 1, with the rubber cushioning sleeve 4 conformally covering the projectile block 3. The projectile block 3 may be disposed in the interior region 24 of the rubber cushioning sleeve 4 such that the rearward ends 18 and 23 of the projectile block 3 and rubber cushioning sleeve 4, respectively, are substantially aligned concentrically about the axis defined by Line 1. The rearward edge of 18 of the projectile block 3 may be inset within the rearward edge 23 of the rubber cushioning sleeve between $1/16^{th}$ and $3/8^{th}$ of an inch, based on the application and the attributes of the specific weapon.

Referring back to FIGS. 2A and 2B, the projectile block 3 includes an interior cavity 25 and a bullet trap 6 formed in the interior region of the projectile block 3 about the axis defined by Line 1. The interior cavity 25 is preferably formed proximate to the rearward end 18 of the projectile block 3. The rear-most portion of the cavity 20 may be tapered, and is preferably formed to a diameter only slightly larger than the exterior diameter of the dock mounting tube 16, which may also be tapered, so as to create a snug male-to-female compression fit between the front end of the dock mounting tube 16 and the mounting point 20 of the projectile 2.

A chamfer transition region 26 is formed between the block mounting point 20 of the projectile block 3 and the bullet trap 6 to further reduce the interior diameter along the length of the projectile block 3. The bullet trap 6 is formed about the axis defined by Line-1, and may vary in diameter depending on the caliber of bullet being fired from the weapon. The bullet trap 6 is preferably slightly larger in diameter than the caliber of the bullet and specifically shaped to allow for some expansion of the bullet inside the trap at impact. This expansion allows a more gradual transfer of kinetic energy to the projectile, which both increases the accuracy of the device, and decreases the launch energy, or "kick" transferred to the shooter. The rounded nose 19 of the projectile block 3 is preferably shaped so as to minimize damage to the rubber-cushioning sleeve 4 on both acceleration and impact.

FIGS. 2A and 2B also illustrate the sequence of events representing the operation of the disclosed device.

The device utilizes the kinetic energy of a bullet 21 fired directly from the firearm 10 into the device of this disclosure that has been attached proximal to the barrel 15 of the firearm 10. As the bullet 21 leaves the barrel of the firearm 15 along the path Line 1, it enters the mounting tube 16 of the device, where a portion of the gas pushing the bullet 21 forward may be bled off via the adjustable venting gasket 9 and exits through gas exhaust vents 5. The gas exhaust vents 5 and the venting areas 27 of the adjustable venting gasket 9 are preferably provided in such a size and number so as to bleed off a certain portion of the expanding gasses created by the combustion of the gunpowder in the shell and the compression caused by the traveling bullet as described above. These vents can be specially manufactured to create a desired velocity for any number of firearms or uses. For example, in testing using a .45 caliber 230 grain round, traveling at 815 feet per second (FPS) and a 2 ounce projectile, projectile speed varied from 240 FPS and 122 PSI (no gasket-four _" vent holes in the mounting tube) to 245 FPS and 128 PSI (no gasket-two _" vent holes in the mounting tube) to 250 FPS and 133 PSI (no gasket-no vent holes on the mounting tube) to 255 FPS and 138 PSI (gasket with two _" lots in the venting areas and no vents in the mounting tube) to 260 FPS and 144 PSI (full gasket, no slots in the venting areas and no vents in the mounting tube). Likewise, similar results were obtained in testing a 9 mm 115 grain round, traveling at 1160 feet per second (FPS) and a 2 ounce projectile, projectile speed varied from 215 FPS and 89 PSI (no gasket-four _" vent holes in the mounting tube) to 220 FPS and 92 PSI (no gasket-two _" vent holes in the mounting tube) to 225 FPS and 97 PSI (no gasket-no vent holes on the mounting tube) to 230 FPS and 101 PSI (gasket with two 11/64" slots in the venting areas and no vents in the mounting tube) to 240 FPS and 110 PSI (gasket with two slots in the venting areas and no vents in the mounting tube) to 245 FPS and 115 PSI (full gasket, no slots in the venting areas and no vents in the mounting tube). For comparison purposes a typical 12 gauge shotgun deployed 1.4 ounce beanbag round, traveling 300 FPS generates 134 PSI. The variable energy values obtained through the different venting options available with this device make it deployable in a greater range of situations and with more convenience than the typical less-lethal device.

The tube 16 may be formed with the base as a single unit, and thus made of the same material.

The bullet 21 then exits the mounting tube 16 in FIG. 2A, and enters the attached projectile 2 of FIG. 2B, where it is caught in the bullet trap 6 formed into the interior cavity of the projectile block 2. When the bullet is captured in the bullet trap 6, the forward kinetic energy of the bullet 21 is transferred to the projectile 2. The projectile 2 then separates from the forward end of the mounting tube 16, and takes flight along the same path of travel Line 1 as the bullet had previously followed.

In flight, the projectile 2 now includes the mass of the bullet 21, plus the combined mass of the projectile block 3 and the rubber-cushioning sleeve 4. This heavier, blunted projectile, having been accelerated with a decreased kinetic energy and having an increased cross-sectional area, contributes to the transformation of the lethal penetrating energy of the bullet into a less lethal blunt force device. The captured bullet in the projectile 2 thus becomes a less-lethal projectile.

It is contemplated that a wide variety of projectile configurations may be used in the present disclosure. One design criterion is the weight ratio of the projectile and bullet combination. Exemplary ratios will now be disclosed.

As will be appreciated by those of ordinary skill in the art, pistol bullets typically range in mass from 90 to 250 grains, with most in the 180 to 230 grain range. In one preferred embodiment, the projectile block 3 of this disclosure ranges from 1 to 2 ounces (480 to 960 grains), and the rubber-cushioning sleeve 4 is a formed rubber cover weighing approximately 0.5 ounce, for total projectile weight of approximately 1.5-2.5 ounces.

In preferred embodiments, the projectile may range from approximately 2.8 to 13.3 times the mass of the bullet of the firearm. It is contemplated that this ratio imparts an effective less-lethal knockdown force on the target.

For a smaller caliber bullet (i.e., 90 grains), exemplary ratios may range from approximately 8:1 to 13.3:1, and for larger calibers, exemplary ranges may range from approximately 2.8:1 to 4.8:1.

As will be appreciated, these mass ratios may vary depending on the knockdown force desired, the caliber of the weapon, and the distance of the target.

It is contemplated that the disclosed ratios may also apply to rifles as well as revolver-type pistols. However, in the case of rifles, there is no movement of the top slider to cause the docking base to auto-eject, and consequently it will have to be removed from the end of the barrel manually. Further embodiments of this device for rifles and more specialized weapons may utilize a combined docking base/projectile to eliminate the need for manual removal of the docking base from the barrel of the weapon.

Referring generally now to FIG. 3, the exploded perspective diagram of a less-lethal projectile system. The figure shows the rear portion 13 of the docking base 1 being configured and shaped to removably attach to the exterior surface a firearm 10. Adjustable venting gasket 9 is shown between the forward portion the firearm 10 and the docking base. It is contemplated that the adjustable venting gasket 9 may be formed of synthetic or natural rubber, urethane, of either the open or closed cell variety, or of a wide variety of rubberized compounds, with the type, thickness, size, presence, and location of vents being chosen in relation to the desired impact and type of weapon utilized. This gasket may be constructed in such a manner as to allow more of the exhaust gasses to exit through the exhaust gas vents 5 in order to control the speed of the projectile 2. The projectile 2 is shown being configured to be coupled to the mounting tube 16 as described above.

Referring more specifically to the docking base 1, it is contemplated that the docking base and tube 1 may be formed from a plastic or similar material, and serves as a collar, which is designed to snuggly attach to a firearm. Variants of the docking base 1 may be manufactured for a particular model of firearm so as to maintain alignment to the barrel of the firearm along the path defined by Line 1.

Figure 4:
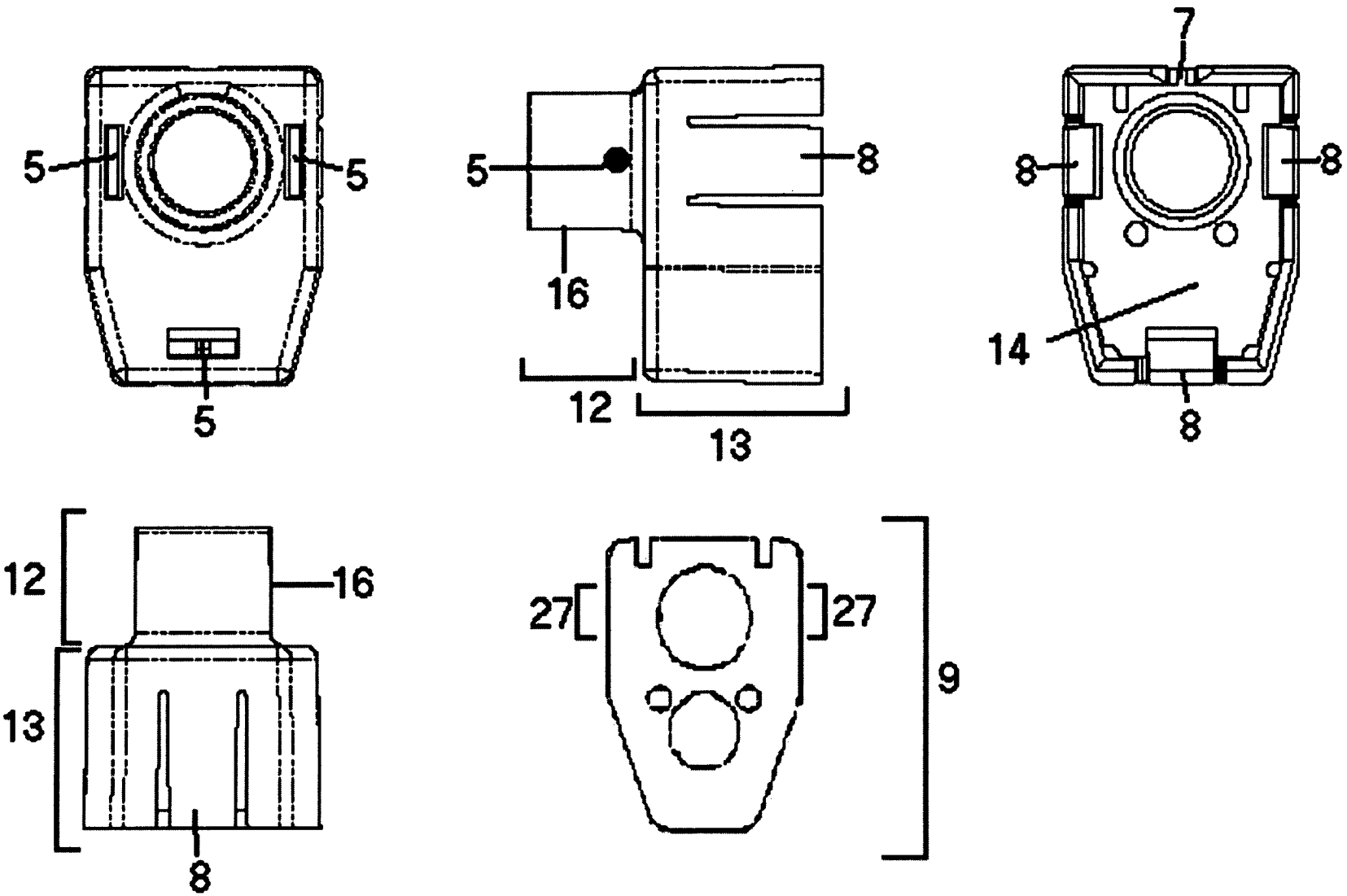
FIG. 4 is a set of 4 perspective views of the docking base and one view of the adjustable venting gasket. These views depict the compression/expansion tabs and the dock vents and gasket venting areas in accordance with the teachings of this disclosure.

Referring generally now to FIG. 4. The rearward end 13 of the docking base 1 may include one or more compression/expansion tabs 8, formed into the base 1 to facilitate expansion and contraction of the rearward end of the docking base 13 so as to facilitate the removable attachment of the base 1 to the forward end of a firearm 10. The compression/expansion slots may be formed to extend radially outward from the inner region 14 of the base outward through the outer surface of the base 1, forming compression members in the rear portion 13 of the base 1.

The size of the interior cavity 14 of the docking base 1 is preferably formed so as to be slightly smaller than the outside surface of the firearm it is designed to fit, thereby requiring the outward flexing of the compression/expansion tabs of rear portion 13 when installing the base 1 onto a firearm. The number and size of these tabs may be determined by the amount of compression force necessary to reliably and accurately seat the base 1 onto a particular firearm, assuring that the device remains properly aligned and affixed to the firearm.

The docking base 1 is preferably formed with a slot 7 designed to fit around the front gun sight without affecting the weapon's alignment or function.

While embodiments and applications of this disclosure have been shown and described, it would be apparent to those skilled in the art that many more modifications and improvements than mentioned above are possible without departing from the inventive concepts herein. The disclosure, therefore, is not to be restricted except in the spirit of the appended claims.

What is claimed is:

1. A less-lethal projectile device comprising:

a base having a rear portion and a forward portion, the rear portion being adapted to removably attach the base to the barrel of a firearm and receive a bullet fired from the firearm along a path defined by the travel of the bullet;

a mounting tube on the forward portion of the base for receiving the bullet along the path;

a projectile having an interior cavity and enveloping a forward portion of the mounting tube along the path;

the projectile being configured to capture the fired bullet within the interior cavity, and detach from the base as a result of kinetic energy transferred to the projectile from the fired bullet, and be accelerated along the path of the bullet to impart a less-lethal force upon a target.

2. The device of claim 1, wherein said base includes at least one vent formed therein.

3. The device of claim 2, wherein said projectile comprises an outer cushioning sleeve formed over a projectile block.

4. The device of claim 3, wherein said base is configured to be kicked off of a firearm as a result of the recoil of the firearm.

5. The device of claim 3, wherein said projectile block comprises a bullet trap formed in an interior cavity for capturing a fired bullet.

6. The device of claim 5, wherein said bullet trap is slightly larger in diameter than the caliber of the bullet and configured to allow for expansion of the bullet inside said bullet trap at impact.

7. The device of claim 3, wherein the mass of said projectile is about 2.8 to about 13.3 times the mass of the bullet of the firearm.

8. The device of claim 7, wherein the mass of said projectile is about 8.0 to about 13.3 times the mass of the bullet of the firearm.

9. The device of claim 7, wherein the mass of said projectile is about 2.8 to about 4.8 times the mass of the bullet of the firearm.

10. A less-lethal projectile device comprising:

base means having a rear portion and a forward portion, the rear portion comprising means for removably attaching the base means to the barrel of a firearm and receive a bullet fired from the firearm along a path defined by the travel of the bullet;

mounting tube means on the forward portion of the base for receiving the bullet along the path;

projectile means releasably coupled to and enveloping a forward portion of the mounting tube along the path;

the projectile comprising means for capturing the fired bullet, and detaching from the base in response to capturing the bullet as a result of kinetic energy transferred to the projectile from the fired bullet, and being accelerated along the path of the bullet, thereby imparting a less-lethal force upon a target.

11. The device of claim 10, wherein said base further comprises multiple areas and means for venting gases formed therein.

12. The device of claim 11, wherein said projectile comprises an outer cushioning means formed over a projectile block.

13. The device of claim 11, wherein said base is configured to be kicked off of a firearm as a result of the cycling of the top action of the firearm.

14. The device of claim 11, wherein said means for capturing the fired bullet comprises a bullet trap formed in an interior cavity for capturing a fired bullet.

15. The device of claim 14, wherein said bullet trap is slightly larger in diameter than the caliber of the bullet and comprises means for allowing expansion of the bullet inside said bullet trap at impact.

16. The device of claim 11, wherein the mass of said projectile is about 2.8 to about 13.3 times the mass of the bullet of the firearm.

17. The device of claim 16, wherein the mass of said projectile is about 8.0 to about 13.3 times the mass of the bullet of the firearm.

18. The device of claim 16, wherein the mass of said projectile is about 2.8 to about 4.8 times the mass of the bullet of the firearm.

* * * * *